US008362680B2

(12) United States Patent
Morioka et al.

(10) Patent No.: US 8,362,680 B2
(45) Date of Patent: Jan. 29, 2013

(54) PLASMA DISPLAY PANEL HAVING LOW RESIDUAL STRESS

(75) Inventors: Kazuhiro Morioka, Kyoto (JP); Morio Fujitani, Osaka (JP); Hirofumi Higashi, Osaka (JP); Shinsuke Yoshida, Hyogo (JP); Akira Kawase, Hyogo (JP); Tatsuo Mifune, Osaka (JP)

(73) Assignee: Panasonic Corporation, Osaka (JP)

( * ) Notice: Subject to any disclaimer, the term of this patent is extended or adjusted under 35 U.S.C. 154(b) by 258 days.

(21) Appl. No.: 12/866,267

(22) PCT Filed: Mar. 11, 2010

(86) PCT No.: PCT/JP2010/001733

§ 371 (c)(1),
(2), (4) Date: Aug. 5, 2010

(87) PCT Pub. No.: WO2010/103836

PCT Pub. Date: Sep. 16, 2010

(65) Prior Publication Data

US 2011/0062854 A1 Mar. 17, 2011

(30) Foreign Application Priority Data

Mar. 13, 2009 (JP) ..... 2009-060500

(51) Int. Cl.
*H01J 1/62* (2006.01)

(52) U.S. Cl. ..... 313/484

(58) Field of Classification Search ..... 313/582–587, 313/483–485

See application file for complete search history.

(56) References Cited

U.S. PATENT DOCUMENTS

| | | | | |
|---|---|---|---|---|
| 2004/0032215 | A1 | 2/2004 | Nishimura et al. | |
| 2004/0041522 | A1 | 3/2004 | Takada et al. | |
| 2006/0019814 | A1* | 1/2006 | Baik et al. | 501/49 |
| 2006/0244378 | A1 | 11/2006 | Shinohe et al. | |
| 2007/0188096 | A1 | 8/2007 | Fujimoto et al. | |
| 2010/0007585 | A1 | 1/2010 | Fujiwara | |

FOREIGN PATENT DOCUMENTS

| | | |
|---|---|---|
| JP | 09-080769 | 3/1997 |
| JP | 2001-045877 | 2/2001 |
| JP | 2002-053342 | 2/2002 |

(Continued)

OTHER PUBLICATIONS

English Translation of JP 2009/048927 A.*

(Continued)

*Primary Examiner* — Anh Mai
*Assistant Examiner* — Hana Featherly
(74) *Attorney, Agent, or Firm* — Wenderoth, Lind & Ponack, L.L.P.

(57) ABSTRACT

In a plasma display panel, in which an area percentage of the display electrodes in an area of an image display region of the front panel is expressed by a longitudinal axis, and a difference between a coefficient of expansion of the front substrate from room temperature to 300° C. and a coefficient of expansion of the dielectric layer from room temperature to 300° C. is expressed by a lateral axis, the difference between the coefficients of expansion and the area percentage stay within a region formed by connecting coordinates ($35\times10^{-7}$/° C., 60%), coordinates ($8\times10^{-7}$/° C., 60%), coordinates ($5\times10^{-7}$/° C., 40%), and coordinates ($23\times10^{-7}$/° C., 40%) in the mentioned order with a straight line where the straight line is included.

12 Claims, 4 Drawing Sheets

FOREIGN PATENT DOCUMENTS

| | | |
|---|---|---|
| JP | 2003-128430 | 5/2003 |
| JP | 2006-310098 | 11/2006 |
| JP | 2007-212801 | 8/2007 |
| JP | 2008-60064 | 3/2008 |
| JP | 2008-243522 | 10/2008 |
| JP | 2009-048927 | 3/2009 |
| JP | 2009-199996 | 9/2009 |
| JP | 2010-132462 | 6/2010 |
| KR | 10-2008-0080769 | 9/2008 |
| WO | 02/17345 | 2/2002 |
| WO | 02/19367 | 3/2002 |
| WO | 2008/015834 | 2/2008 |
| WO | 2008/117535 | 10/2008 |

OTHER PUBLICATIONS

Engish translation of previously cited JP 2009/048927 A (Publication Date: Mar. 5, 2009) to Gotou et al.*

* cited by examiner

PLASMA DISPLAY PANEL HAVING LOW RESIDUAL STRESS

TECHNICAL FIELD

The present invention relates to a plasma display panel used in, for example, a display device.

BACKGROUND ART

A plasma display panel (hereinafter, called PDP) which meets the needs for higher definition and a larger screen is often used in 100-inch or larger televisions. In recent years, there is an ongoing trend to use the PDP in high-definition televisions in which scan lines are at least doubled as compared with a conventional NTSC televisions. Another recent trend is lead-free PDPs, which were launched in the market to contribute to an environmental protection.

The basic structural elements of the PDP are a front panel and a back panel. The front panel has a glass substrate made of sodium borosilicate glass by the float method. On one of the main surfaces of the glass substrate are formed display electrodes consisting of stripe-like transparent electrodes and bus electrodes. The display electrodes are covered with a dielectric layer functioning as a capacitor, and a protective layer made of magnesium oxide (MgO) is formed on the dielectric layer. In the back panel having a glass substrate, stripe-like address electrodes are formed on one of main surfaces of the glass substrate. The address electrodes are covered with a ground dielectric layer, and barrier ribs are formed on the ground dielectric layer. Phosphor layers, which respectively emit red, green, and blue lights, are formed between the barrier ribs.

The front panel and the back panel are air-tightly sealed with their electrode-formed surfaces facing each other. Ne—Xe discharge gas is enclosed at a pressure between 55 kPa and 80 kPa in a discharge space which is divided by the barrier ribs. The PDP generates an electric discharge by selectively applying a video signal voltage to the display electrodes, and ultraviolet generated by the discharge excites the phosphor layers to make them emit the red, green, and blue lights so that a color image is displayed.

Silver electrodes are used to ensure conductivity as the bus electrodes constituting the display electrodes, and low-melting glass containing lead oxide as its principal ingredient is used in the dielectric layer. Faced with the environmental consciousness escalating in recent years, lead-free dielectric layers were disclosed (for example, see the Patent Documents 1, 2, 3, and 4).

According to the conventional technology, the front panel was provided with, generally called transparent electrodes, which transmit visible light to ensure an expected numerical aperture. However, different approaches are currently underway to reliably obtain conductivity by providing metal electrodes alone in the display electrodes while omitting the transparent electrodes for cost reduction.

In the conventional structure, two display electrodes are formed in one scan line, and one transparent electrode and one metal electrode are formed in one display electrode. The omission of the transparent electrodes, however, inevitably increases number of metal electrodes to be provided in one display electrode in a ladder-like structure to ensure conductivity. Silver (Ag) included in the metal electrode has a large coefficient of expansion. Therefore, a stress exerted in the direction of compression is applied to the glass substrate after the dielectric layer is formed. Thus, a residual stress generated in the glass substrate has the direction of compression.

As a larger number of metal electrodes are provided, the residual stress of the glass substrate further increases in the direction of compression in proportion to a total area of the metal electrodes. In the case where the residual stress of the glass substrate after the dielectric layer is formed in the direction of compression, a residual stress of the dielectric layer on the film-surface side, on the other hand, is exerted in the direction of tension. With the respective stresses being thus reversely generated, the front panel may collide with the back panel when they are disposed facing each other to be sealed. The collision may generate fine cracks, accelerating substrate breakage. Another problem is a voltage load imposed on the fine cracks generated in the dielectric layer when an image is displayed, resulting in insulation failure in any portions where the cracks are generated. In addition, in a lead-free dielectric layer, this phenomenon remarkably occurs.

A main object of the present invention is to provide a PDP capable of reliably acquiring a remarkable luminance level and a high reliability during a high-definition image display and meeting the needs for environmental protection.

CITATION LIST

Patent Documents

Patent Document 1: Unexamined Japanese Patent Publication No. 2003-128430

Patent Document 2: Unexamined Japanese Patent Publication No. 2002-053342

Patent Document 3: Unexamined Japanese Patent Publication No. 2001-045877

Patent Document 4: Unexamined Japanese Patent Publication No. H09-050769

DISCLOSURE OF THE INVENTION

A PDP according to the present invention has a front panel and a back panel, wherein the front panel and the back panel are disposed facing each other, and their peripheral portions are sealed to form a discharge space therein. The front panel has display electrodes, a dielectric layer, and a protective layer on a front substrate thereof. The back panel has electrodes, barrier ribs, and a phosphor layer on a back substrate thereof. In which an area percentage of the display electrodes in an area of an image display region of the front panel is expressed by a longitudinal axis, and a difference between a coefficient of expansion of the front substrate from room temperature to 300° C. and a coefficient of expansion of the dielectric layer from room temperature to 300° C. is expressed by a lateral axis, the difference between the coefficients of expansion and the area percentage stay within a region formed by connecting coordinates ($35\times10^{-7}$/° C., 60%), coordinates ($8\times10^{-7}$/° C., 60%), coordinates ($5\times10^{-7}$/° C., 40%), and coordinates ($23\times10^{-7}$/° C., 40%) with a straight line in order where the straight line is included.

According to the technical characteristic, insulation failure of the dielectric layer and warp of the substrates are less likely to happen notwithstanding any increase of the area percentage of the display electrodes resulting from the omission of transparent electrodes.

The present invention can provide an environment-friendly PDP capable of reliably acquiring a remarkable luminance level and a high reliability during a high-definition image display.

PREFERRED EMBODIMENTS FOR CARRYING OUT OF THE INVENTION

Summary of PDP 1

Figure 1:
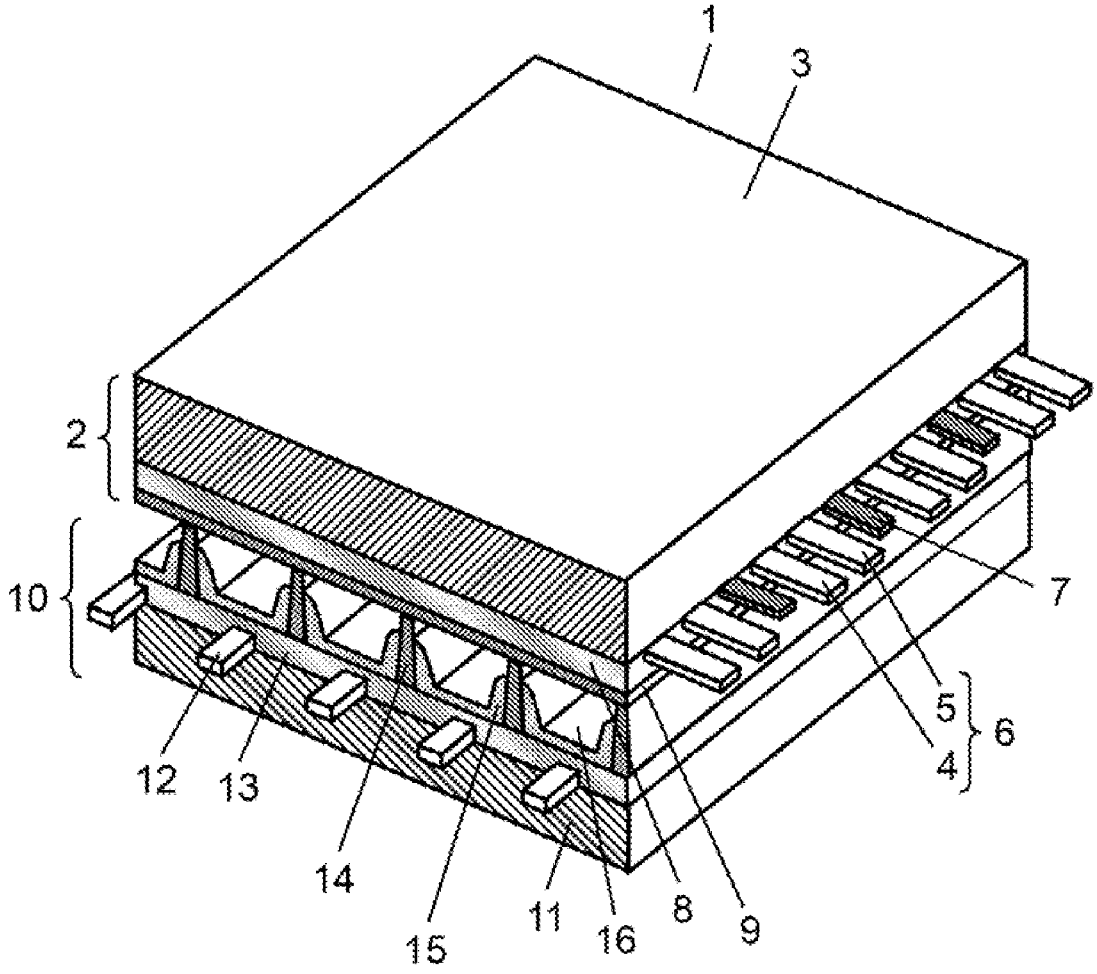
FIG. 1 is a perspective view illustrating a structure of a PDP according to a preferred embodiment.

PDP 1 according to a preferred embodiment of the present invention is an alternating current discharge PDP. As illustrate in FIG. 1, PDP 1 has a structure where front panel 2 including front glass substrate 3 and back panel 10 including back glass substrate 11 are disposed facing each other. Outer peripheral portions of front panel 2 and back panel 10 are air-tightly sealed by a sealing member made of, for example, glass frit. A discharge gas containing, for example, Ne and Xe is enclosed at a pressure between 55 kPa-80 kPa in discharge space 16 of an inner space of PDP 1 formed by sealing the panels.

On front glass substrate 3, a plurality of display electrodes 6 each having a pair of scan electrode 4 and sustain electrode 5 formed in a belt shape, and a plurality of black stripes (shielding layers) 7 are provided in parallel with each other in a plurality of rows. Further, dielectric layer 8 functioning as a capacitor is formed on front glass substrate 3 so as to cover display electrodes 6 and shielding layers 7. Protective layer 9 made of, for example, magnesium oxide (MgO) is formed on a surface of dielectric layer 8.

On back glass substrate 11, a plurality of address electrodes 12 formed in a belt shape are disposed in parallel with one another in a direction orthogonal to display electrodes 6 of front panel 2. Further, ground dielectric layer 13 is formed so as to cover address electrodes 12, and barrier ribs 14 having a predetermined height dimension which sectionalize discharge space 16 are formed on ground dielectric layer 13 disposed among address electrodes 12. Between barrier ribs 14, phosphor layers 15, which respectively emit red light, blue light, and green light through the irradiation of ultraviolet, are sequentially formed.

A discharge cell is formed at a position where display electrode 6 intersects with address electrode 12. The discharge cell having phosphor layer 15 which emits red light, the discharge cell having phosphor layer 15 which emits blue light, and the discharge cell having phosphor layer 15 which emits green light constitute a pixel for color display.

Method of Producing PDP 1

Method of Producing Front Panel 2

First, scan electrodes 4, sustain electrodes 5, and shielding layers 7 are formed on front glass substrate 3. Scan electrode 4 and sustain electrode 5 respectively have white electrode 4*b* and white electrode 5*b* including silver (Ag) which serves to ensure conductivity. Scan electrode 4 and sustain electrode 5 also respectively have black electrode 4*a* and black electrode 5*a* including black pigment which improves contrast on an image display surface. White electrode 4*b* is placed on black electrode 4*a*, and white electrode 5*a* is placed on black electrode 5*a*.

More specifically, front glass substrate 3 is coated with a black paste including black pigment by, for example, screen printing so that a black paste layer (not illustrated in the drawing) is formed. Next, the black paste layer (not illustrated in the drawing) is patterned by photolithography. Then, the black paste layer (not illustrated in the drawing) is coated with a white paste including silver (Ag) by, for example, screen printing so that a white paste layer (not illustrated in the drawing) is formed. Then, the white paste layer (not illustrated in the drawing) and the black paste layer (not illustrated in the drawing) are patterned by photolithography. After that, the black paste layer (not illustrated in the drawing) and the white paste layer (not illustrated in the drawing) are subject to a developing process and then fired. As a result, white electrodes 4*b* and 5*b* and black electrodes 4*a* and 5*a* constituting display electrodes 6, and shielding layers 7 are formed.

Front glass substrate 3 is coated with a dielectric paste so as to cover scan electrodes 4, sustain electrodes 5, and shielding layers 7 by, for example, die coating so that a dielectric paste layer (not illustrated in the drawing) is formed. After a given period of time thereafter passed, a surface of the dielectric paste layer (not illustrated in the drawing) is leveled. The dielectric paste layer is then fired, and dielectric layer 8 which covers scan electrodes 4, sustain electrodes 5, and shielding layers 7 is formed.

The dielectric paste is a coating composition including dielectric glass such as glass powder, a binder, and a solvent.

Finally, protective layer 9 made of magnesium oxide (MgO) is formed on dielectric layer 8 by vacuum evaporation.

As a result of the processing steps described so far, scan electrodes 4, sustain electrodes 5, shielding layers 7, dielectric layer 8, and protective layer 9 are formed on front glass substrate 3, and the production of front panel 2 is completed.

Method of Producing Back Panel 10

A method of producing back panel 10 is described below.

First, address electrodes 12 are formed on back glass substrate 11. More specifically, back glass substrate 11 is coated with a paste including silver (Ag) by screen printing so that an address electrode paste layer (not illustrated in the drawing) is formed. Next, the address electrode paste layer (not illustrated in the drawing) is patterned by photolithography so that a structural element serving as a material layer for the formation of address electrodes 12 (not illustrated in the drawing) is formed. When the structural element (not illustrated in the drawing) is fired at a predetermined temperature, address electrodes 12 are formed. Another example of the method of processing the paste other than screen printing is to form a metal film on back glass substrate 1 by, for example, sputtering or vapor deposition.

Then, back glass substrate 11 where address electrodes 12 are formed is coated with a ground dielectric paste by, for example, die coating so as to cover address electrodes 12. As a result, a ground dielectric paste layer (not illustrated in the drawing) is formed. The ground dielectric paste layer (not illustrated in the drawing) is then fired so that ground dielectric layer 13 is formed. The ground dielectric paste is a coating composition including a ground dielectric material such as glass powder, a binder, and a solvent.

A barrier rib formation paste including a barrier rib material is spread on ground dielectric layer 13A so that a barrier rib paste layer (not illustrated in the drawing) is formed. When the barrier rib paste layer (not illustrated in the drawing) is patterned by photolithography, a material layer for the formation of barrier ribs 14 (not illustrated in the drawing) is formed. When the material layer (not illustrated in the drawing) is fired, barrier ribs 14 are formed. Examples of a method of patterning the barrier rib paste layer spread on ground dielectric layer 13 are photolithography and sand blasting.

An upper surface of ground dielectric layer 13 between the adjacent barrier ribs 14 and side surfaces of barrier ribs 14 are coated with a phosphor paste including a fluorescent material. The phosphor paste is then fired so that phosphor layer 15 is formed.

As a result of the processing steps described so far, the production of back panel 10 having required structural elements on back glass substrate 11 is completed.

Method of Assembling Front Panel 2 and Back Panel 10

First, front panel 2 and back panel 10 are disposed facing each other so that display electrodes 6 and address electrodes 12 are orthogonal to each other. The peripheral portions of front panel 2 and back panel 10 are sealed with glass frit. A discharge gas including, for example, Ne, Xe is enclosed in discharge space 16, and PDP 1 is finally obtained.

Information of Dielectric Layer 8

To ensure insulation reliability by controlling the occurrence of fine cracks in dielectric layer 8, there is desirably a residual stress in the direction of compression after dielectric layer 8 is fired. To obtain such a residual stress, it is necessary that there be a residual stress in the direction of tension in front glass substrate 3.

Method of Measuring Residual Stress

According to the present preferred embodiment, a polariscope (Polarimeter SF11, supplied by Shinko Seiki Co., Ltd.) was used to measure the residual stress of front glass substrate 3. The polariscope utilizes polarization of light, and thus a phase difference between two lights generated when light passed through an object having a distortion is detected to measure the state and dimensions of the distortion. As far as the residual stress is present in front glass substrate 3, there is accordingly a distortion in front glass substrate 3. When the polariscope is used, therefore, the residual stress of front glass substrate 3 can be measured.

Figure 2:
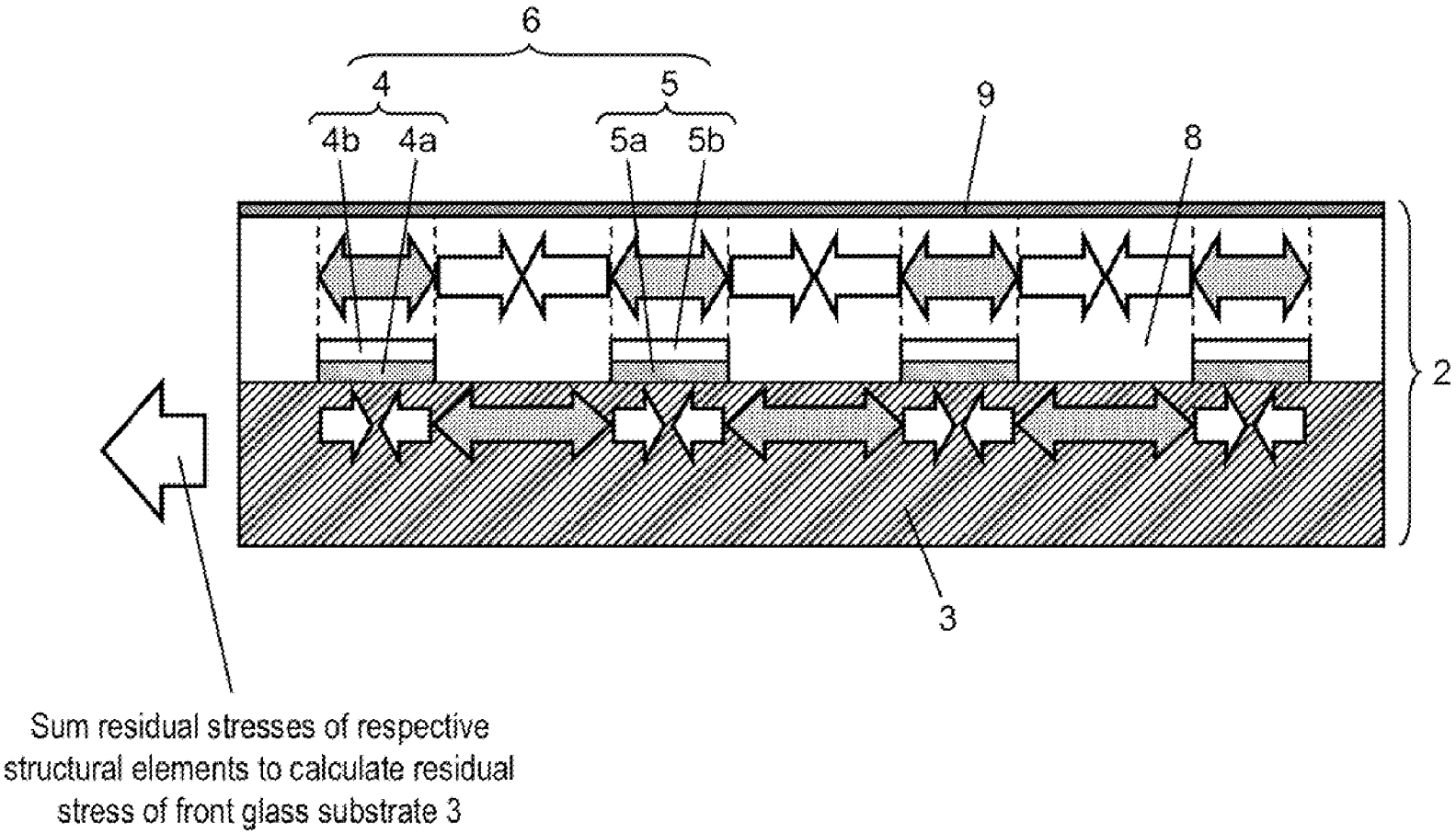
FIG. 2 is a sectional view schematically illustrating a structure of a front panel and a residual stress according to the preferred embodiment.

FIG. 2 is a schematic illustration of the residual stress present in the structural elements of front panel 2 according to the present preferred embodiment. To simplify the description, shielding layer 7 is omitted in the drawing. Below is described in detail a method of measuring the residual stress. First, front panel 2 is cut away in predetermined dimensions, and end portions of front panel 2 orthogonal to a direction where display electrodes 6 extend are placed on a stage of the polarisccope. Then, an end surface of front panel 2 is irradiated with a white light emitted from a light source provided in a lower section of the stage, and light passing through front panel 2 is detected by a detector. Thus, the residual stress in a portion of front glass substrate 3 immediately below display electrodes 6, and the residual stress in a portion of front glass substrate 3 having no display electrode 6, which is a portion thereof immediately below dielectric layer 8, are separately measured.

Then, the residual stress of front glass substrate 3 immediately below display electrodes 6, and the residual stress of front glass substrate 3 immediately below dielectric layer 8 are summed to calculate a total residual stress in front glass substrate 3.

The residual stress according to a measurement result is a plus value in the case where a compression stress is generated in front glass substrate 3, while it is a minus value in the case where a tensile stress is generated in front glass substrate 3. With the residual stress of front panel 2 presenting a plus value, however, a tensile stress is generated in dielectric layer 8, which raises the likelihood of generating fine cracks in dielectric layer 8. Then, dielectric layer 8 is not strong enough, and its insulation reliability is undermined. Therefore, it is desirable that the residual stress of front glass substrate 3 be a minus value.

To prevent the occurrence of fine cracks in dielectric layer 8, the residual stress of front glass substrate 3 is preferably 0.0 MPa or less. In this case, there is no residual stress in dielectric layer 8. The residual stress of front glass substrate 3 is preferably 0.5 Mpa or less. In this case, the residual stress is generated in the direction of compression in dielectric layer 8. As a result, fine cracks can be more effectively prevented from happening.

In the case where the residual stress of front glass substrate 3 is smaller than −2.0 MPa, however, the warp of front panel 2 is increased. To produce PDP 1 more efficiently, a technique for obtaining multiple panels from one substrate was introduced in recent years, wherein a large glass substrate is cut after structural elements are formed thereon so that multiple front panels 2 and back panels 10 can be obtained. Along with the introduction of the new technique, larger glass substrates are used in the production of front panel 2 and back panel 10. In this large substrate, the glass substrates are even more likely to warp, causing a huge problem in the production process. Therefore, the residual stress of front glass substrate 3 is more desirably −1.5 MPa or more.

Therefore, the range of the residual stress in front glass substrate 3 is desirably −2.0 MPa or more and 0.0 MPa or less, and more desirably −1.5 MPa or more and −0.5 MPa or less.

Coefficient of Expansion of Dielectric Layer 8

In the present preferred embodiment, the residual stress of front glass substrate 3 can be suitably set by controlling a coefficient of expansion of dielectric layer 8. More specifically, the residual stress of front glass substrate 3 can be suitably set by controlling a difference between a coefficient of expansion of a glass substrate used as front glass substrate 3 and the coefficient of expansion of dielectric layer 8. Front glass substrate 3 used in the present preferred embodiment is a glass substrate in which the coefficient of expansion from room temperature to 300° C. is $83\times10^{-7}$/° C. The coefficient of expansion given in the description below shows values obtained from room temperature to 300° C.

Figure 3:
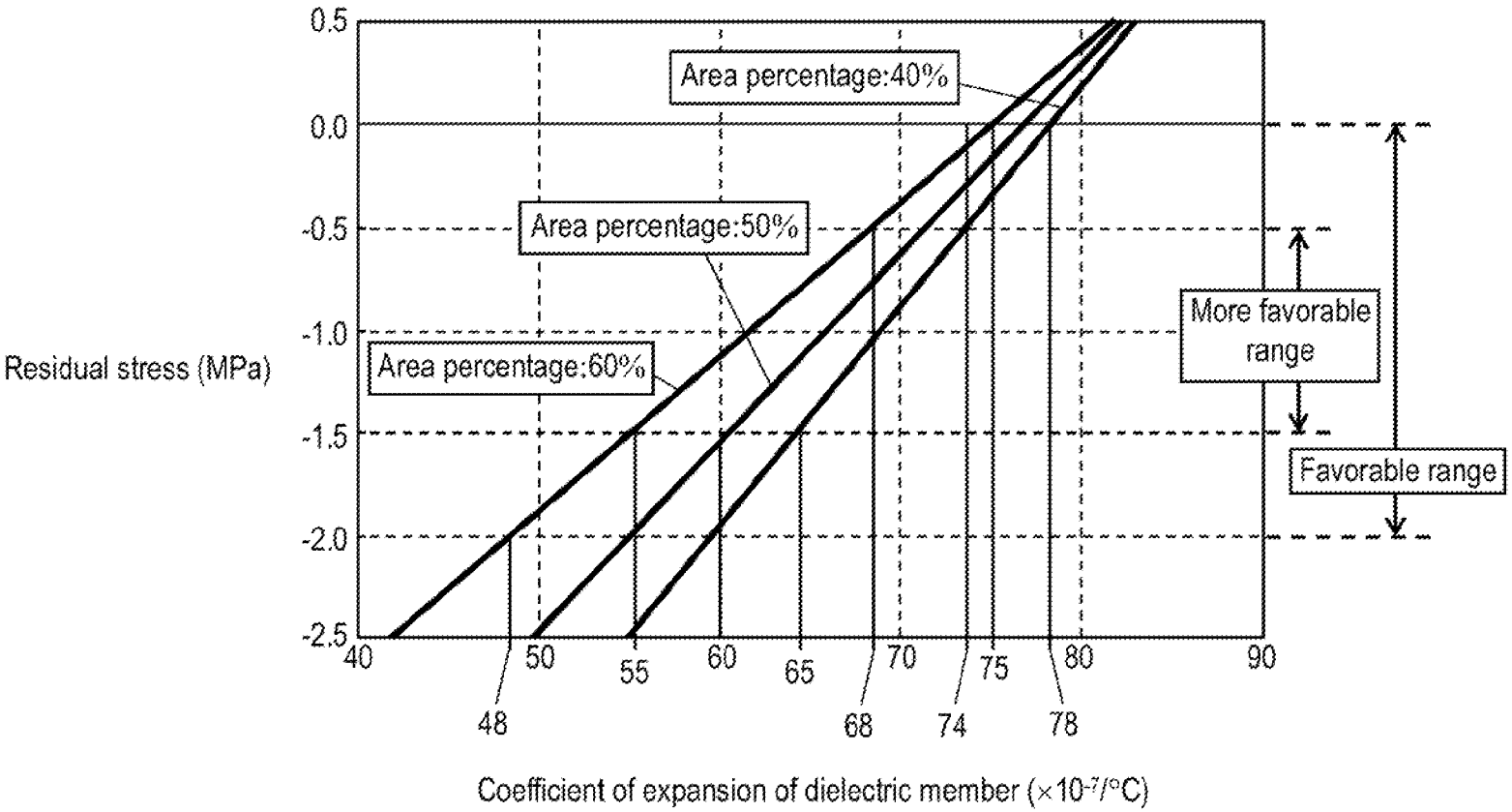
FIG. 3 is a graph illustrating a relationship between a coefficient of expansion of a dielectric member and a substrate residual stress.

The studies and discussions carried out by the inventors of the present invention made it clear that a suitable coefficient of expansion of dielectric layer 8 depends on a proportion of an area of display electrodes 6 formed on front glass substrate 3 to an image display region. As illustrated in FIG. 3, a preferable range is defined for a relationship between the coefficient of expansion of dielectric layer 8 and the residual stress of front glass substrate 3. The inventors discussed a few examples of the area proportion of display electrodes 6 to the image display region, 40%, 50%, and 60% (hereinafter, referred to as area percentage). With the area percentage less than 40%, display electrodes 6 fail to have an expected conductivity, deteriorating the discharge property of PDP 1. With the area percentage more than 60%, front panel 2 fails to have a target numeral aperture, leading to the deterioration of the luminance level of PDP 1. Therefore, it is concluded that the area percentage is 40% or more and 60% or less.

It is known from FIG. 3 that the relationship between the residual stress (MPa) and the coefficient of expansion ($\times10^{-7}$° C.) is variable depending on the area percentage. More specifically, the residual stress is represented by P and the coefficient of expansion is represented by $\alpha$, $P=0.108\alpha-8.470$ with the area percentage of 40%, $P=0.092\alpha-7.048$ with the area percentage of 50%, and $P=0.075\alpha-5.625$ with the area percentage of 60%.

To obtain the residual stress of 0.0 MPa or less, the following conditions are demanded. The coefficient of expansion is $78\times10^{-7}$/° C. or less with the area percentage of 40%. The coefficient of expansion is $77\times10^{-7}$/° C. or less with the area percentage of 50%. The coefficient of expansion is $75\times10^{-7}$/° C. or less with the area percentage of 60%.

The difference between the coefficients of expansion of front glass substrate 3 and dielectric layer 8 is $5\times10^{-7}$/° C. or less with the area percentage of 40%, $6\times10^{-7}$/° C. or less with the area percentage of 50%, and $8\times10^{-7}$/° C. or less with the area percentage of 60%.

To obtain the residual stress of −2.0 MPa or more, the following conditions are demanded. The coefficient of expansion is $60\times10^{-7}$/° C. or more with the area percentage of 40%. The coefficient of expansion is $55\times10^{-7}$/° C. or less with the area percentage of 50%. The coefficient of expansion is $48\times10^{-7}$/° C. or more with the area percentage of 60%.

To obtain the residual stress of −2.0 MPa or more, the following conditions are demanded for the difference between the coefficients of expansion of front glass substrate 3 and dielectric layer 8. The difference between the coefficients of expansion is $23\times10^{-7}$/° C. or more with the area percentage of 40%. The difference between the coefficients of expansion is $28\times10^{-7}$/° C. or more with the area percentage of 50%. The difference between the coefficients of expansion is $35\times10^{-7}$/° C. or more with the area percentage of 60%.

To obtain the residual stress of −0.5 MPa or less, the following conditions are demanded. The coefficient of expansion is $74\times10^{-7}$/° C. or less with the area percentage of 40%. The coefficient of expansion is $72\times10^{-7}$/° C. or more with the area percentage of 50%. The coefficient of expansion is $68\times10^{-7}$/° C. or less with the area percentage of 60%.

To obtain the residual stress of −0.5 MPa or less, the following conditions are demanded for the difference between the coefficients of expansion of front glass substrate 3 and dielectric layer 8. The difference between the coefficients of expansion is $9\times10^{-7}$/° C. or less with the area percentage of 40%. The difference between the coefficients of expansion is $11\times10^{-7}$/° C. or less with the area percentage of 50%. The difference between the coefficients of expansion is $15\times10^{-7}$/° C. or more with the area percentage of 60%.

To obtain the residual stress of −1.5 MPa or more, the following conditions are demanded. The coefficient of expansion is $65\times10^{-7}$/° C. or more with the area percentage of 40%. The coefficient of expansion is $61\times10^{-7}$/° C. or more with the area percentage of 50%. The coefficient of expansion is $55\times10^{-7}$/° C. or more with the area percentage of 60%.

To obtain the residual stress of −1.5 MPa or more, the following conditions are demanded for the difference between the coefficients of expansion of front glass substrate 3 and dielectric layer 8. The difference between the coefficients of expansion is $18\times10^{-7}$/° C. or more with the area percentage of 40%. The difference between the coefficients of expansion is $22\times10^{-7}$/° C. or more with the area percentage of 50%. The difference between the coefficients of expansion is $28\times10^{-7}$/° C. or more with the area percentage of 60%.

The area percentages are calculated from design numeral values of front panel 2. When front panel 2 is actually made, its area percentage undergoes an error in the range of ±3% resulting from variability of an electrode shape and measurement errors.

Figure 4:
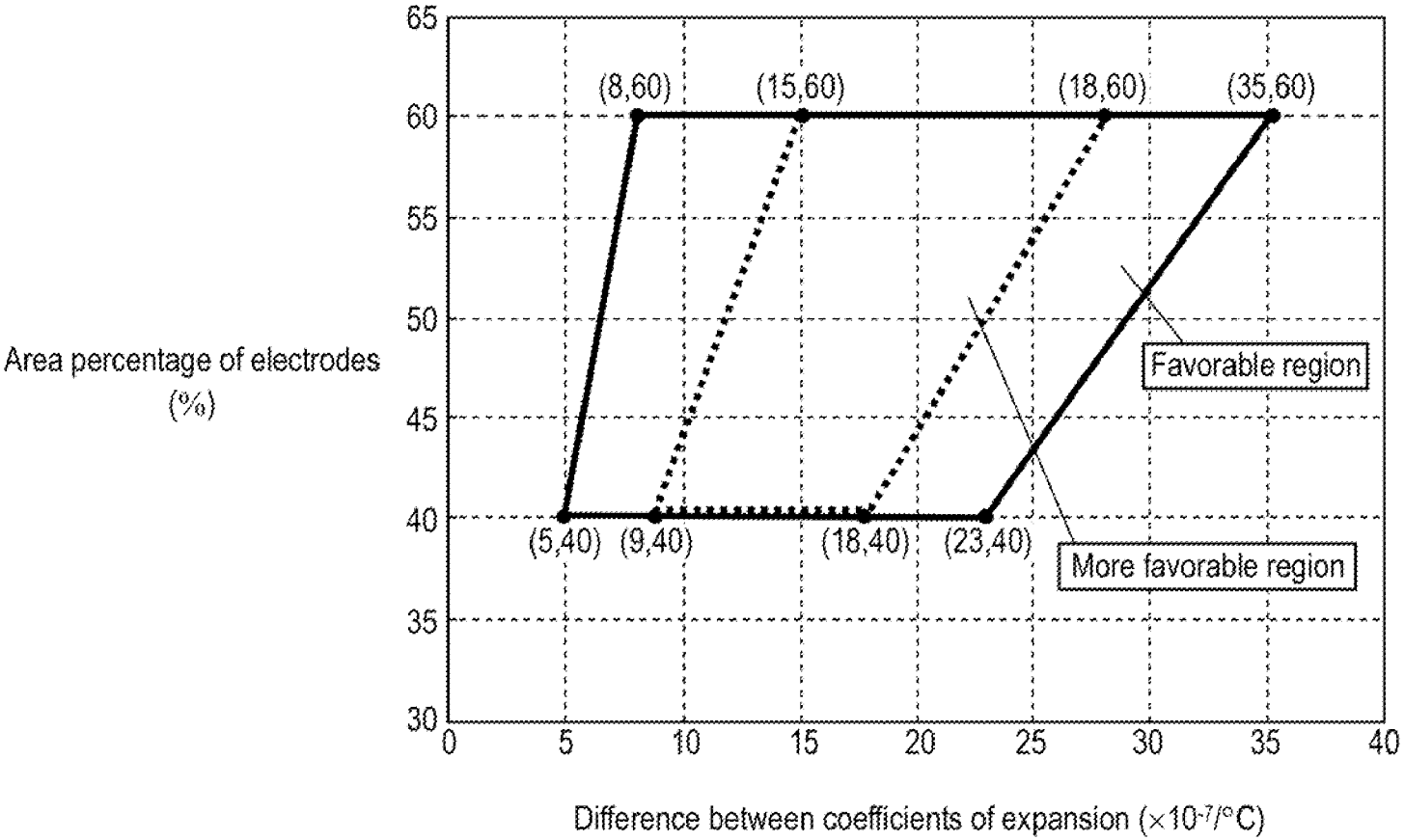
FIG. 4 is a graph illustrating a relationship between the coefficient of expansion of the dielectric member and an area percentage of electrodes.

As illustrated in FIG. 4, the present preferred embodiment is technically characterized in that, in a graph in which the area percentage of display electrodes 6 in the area of the image display region of front panel 2 is expressed by a longitudinal axis, and the difference between the coefficient of expansion of front glass substrate 3 from room temperature to 300° C. and the coefficient of expansion of dielectric layer 8 from room temperature to 300° C. is expressed by a lateral axis, the difference between the coefficients of expansion and the area percentage stay within a region obtained by connecting coordinates ($35\times10^{-7}$/° C., 60%), coordinates ($8\times10^{-7}$/° C., 60%), coordinates ($5\times10^{-7}$/° C., 40%), and coordinates ($23\times10^{-7}$/° C., 40%) with a straight line in order where the straight line is included.

It is more desirable that the difference between the coefficients of expansion and the area percentage stay within a region obtained by connecting coordinates ($28\times10^{-7}$/° C., 60%), coordinates ($15\times10^{-7}$/° C., 60%), coordinates ($9\times10^{-7}$/° C., 40%), and coordinates ($18\times10^{-7}$/° C., 40%) with a broken line in order where the broken line is included.

Method of Forming Dielectric Layer 8

A paste including a solvent containing glass powder and resin, a plasticizer, and binder component is used as a material of dielectric layer 8. Front glass substrate 3 is coated with the paste by, for example, screen printing or die coating. The paste is dried and then fired at a temperature in the range of 450° C. to 600° C., preferably in the range of 550° C. to 590° C., so that dielectric layer 8 is formed. Another example of the method of forming dielectric layer 8 is as follows. First, a sheet obtained by coating and drying the paste on the film is used as its material. The paste formed on the sheet is transferred to front glass substrate 3, and then fired at a temperature in the range of 450° C. to 600° C., preferably in the range of 550° C. to 590° C., so that dielectric layer 8 is formed.

The luminance level of PDP 1 is bettered as the film thickness of dielectric layer 8 is smaller, and a discharge voltage of PDP 1 decreases as the film thickness of dielectric layer 8 is smaller. Therefore, it is preferable to form dielectric layer 8 in such a thickness that is very small but does not deteriorate a dielectric strength voltage. An example of the film thickness of dielectric layer 8 presented in the present preferred embodiment is 15 μm or more and 41 μm or less in perspective of the dielectric strength voltage and transmittance of visible light.

Composition of Dielectric Glass

To enable firing at approximately 450° C. to 600° C., a glass component included in a dielectric layer (dielectric glass) conventionally includes lead oxide by 20 wt. % or more. However, a paste increasingly used in view of environmental protection in recent years does not include lead oxide in the dielectric glass but includes dibismuth trioxide ($Bi_2O_3$) by 0.5 wt. % or more and up to 40 wt. %. Such a paste, however, imposes a voltage load on fine cracks generated in dielectric layer 8, raising the likelihood of causing insulation failure in any portions where the fine cracks are generated.

In the present preferred embodiment, the dielectric glass in which the difference between the coefficients of expansion stays in the ranges described earlier constitutes dielectric layer 8. Dielectric layer 8 may be made of a dielectric glass material not including lead oxide but including $Bi_2O_3$.

Examples of the substances that can be included in dielectric layer 8 according to the present preferred embodiment are barium oxide (BaO) and calcium oxide (CaO). A volume of BaO and CaO included in total is 17 mol % or less, and preferably 8 mol % or less.

In BaO and CaO, its cation radius in glass is larger than ion radiuses of silicon dioxide ($SiO_2$) and diboron trioxide ($B_2O_3$) which are fundamental oxides constituting glass. A probable theory based on the characteristic is that BaO and CaO included in dielectric layer 8 broadens the network of glass therein, thereby increasing the coefficient of expansion of dielectric layer 8. In the case where the total content of BaO and CaO exceeds 17 mol %, the coefficient of expansion of dielectric layer 8 becomes too large, generating the residual stress of front glass substrate 3 in the direction of compression. This case is not preferable because the insulation reliability of dielectric layer 8 is lowered.

In the present preferred embodiment, dielectric layer 8 may include ZnO, and ZnO is preferably included by 10 mol % or more and by 50 mol % or less. In ZnO contained in glass, its cation radius is smaller than cation radiuses of BaO and CaO, whereas it is larger than ion radiuses of $SiO_2$ and $B_2O_3$. When ZnO is included in dielectric layer 8, therefore, the coefficient of expansion of dielectric layer 8 is increased. In the case where the content of ZnO exceeds 50 mol %, the coefficient of expansion becomes too large, which is not preferable because the residual stress is generated in the direction of compression in front glass substrate 3 to lower the insulation reliability. In the case where the content of ZnO is less than 10 mol %, the coefficient of expansion unfavorably becomes too small, increasing the warp of front glass substrate 3.

In the present preferred embodiment, dielectric layer 8 may include copper oxide II (CuO) and cobalt oxide (CoO). A volume of CuO and CoO included in total is preferably 0.1 mol % or more and 0.5 mol % or less. When dielectric layer 8 is fired, CuO is reduced into copper oxide I ($Cu_2O$). This reduction reaction controls the reduction of silver (Ag) included in display electrodes 6 into silver ions ($Ag^+$) diffused in dielectric layer 8, and dielectric layer 8 can be thereby prevented from turning yellow.

It became clear that CuO acts on the dielectric glass to develop blue color, and $Cu_2O$ acts on the dielectric glass to develop green color. The inventors of the present invention finally found out what causes the development of such colors and a way to solve the problem.

During the production process of PDP 1 including an assembling step, it is necessary to perform a firing step a few times. The reduction of CuO into $Cu_2O$ is very susceptible to environmental conditions such as oxygen concentration in the firing step, and another problem is difficulty in controlling the level of reduction. Due to these problems, dielectric layer 8 conventionally has a portion where the reduction of CuO is accelerated beyond the expected level which enhances the blue color development, while there is another portion where the reduction of CuO fails to reach the expected level which enhances the green color development. Accordingly, in-plane variability is more likely to occur in color development in PDP 1, leading to variable in-plane luminance level and chromaticity of PDP 1 during an image display. A desirable image quality cannot be obtained from such PDP 1.

To additionally include CoO in the dielectric glass is a solution according to the present preferred embodiment for controlling the coloring variability of dielectric layer 8 depending on the level of CuO reduction. Although CoO acts on the dielectric glass to develop blue color in a manner similar to CuO, CoO added to the dielectric glass helps to relatively stabilize the blue color development. Therefore, the image quality of PDP 1 is prevented from deteriorating.

In the case where a volume of CuO and CoO included in total exceeds 0.5 mol %, the blue color development of the dielectric glass is too powerful to maintain the image quality of PDP 1. In the case where CoO alone is added, it is not possible to control the reduction of silver ions ($Ag^+$), and dielectric layer 8 accordingly has a lower in-line transmittance. The blue light development stays in an optimal range, and the image quality of PDP 1 is favorable as far as the total volume of CuO and CoO included in total is 0.5 mol % or less. The total volume of CuO and CoO below 0.1 mol % is not preferable, failing to control the reduction of silver ions ($Ag^+$).

In the present preferred embodiment, molybdenum trioxide ($MoO_3$), for example, may be included in dielectric layer 8. A volume of $MoO_3$ included in dielectric layer 8 is preferably 0.3 mol % or more and 2.0 mol % or less. When $MoO_3$ is added to the dielectric glass including $Bi_2O_3$ by 0.3 mol % or more, such compounds as $Ag_2MoO_4$, $Ag_2Mo_2O_7$, and $Ag_2Mo_4O_{13}$ can be easily produced at low temperatures of 580° C. or less. In the present preferred embodiment, dielectric layer 8 is fired at 550° C. to 590° C. Therefore, silver ions ($Ag^+$) diffused in dielectric layer 8 during firing reacts with $MoO_3$ included in dielectric layer 8 to produce stable compounds, supporting stabilization of silver ions. The silver ions can be stabilized without the reduction of silver ions ($Ag^+$), which eliminates the possibility that silver ions (Ag+) are aggregated into silver (Ag) colloid. When the silver ions are thus stabilized, oxygen associated with colloidization of silver (Ag) is reduced, and the reduction of oxygen leads to less air bubbles in dielectric layer 8.

In the case where $MoO_3$ is added by more than 2 mol %, crystallization of the dielectric glass is accelerated during firing, causing white turbidity in the dielectric glass. Then, the visible light transmittance of dielectric layer 8 is deteriorated, and the luminance level of PDP 1 thereby falls, resulting in deterioration of the image quality of PDP 1. A similar effect can be obtained when a metal oxide, such as tungsten trioxide ($WO_3$), cerium dioxide ($CeO_2$), or manganese dioxide ($MnO_2$), is added to the dielectric glass in place of $MoO_3$.

In the present preferred embodiment, $Bi_2O_3$ may be included in dielectric layer 8 by 5 mol % or less. To add more $Bi_2O_3$ lowers a softening point of the dielectric glass, and various advantages, such as temperature reduction in the production process, can be obtained. The Bi-based materials are expensive materials, and thus adding a large volume of $Bi_2O_3$ invites increase of material costs. Therefore, an exemplary volume of $Bi_2O_3$ according to the present preferred embodiment is 5 mol % or less.

For example, the coefficient of expansion of dielectric layer 8 made of the dielectric glass including $Bi_2O_3$ by 3.0 mol %, $MoO_3$ by 0.7 mol %, BaO and CaO in total by 9.5 mol %, ZnO by 44.2 mol %, and other material compositions by 42.5 mol % was $73\times10^{-7}$/° C.

The other material compositions are, for example, boron oxide ($B_2O_3$), silicon oxide ($SiO_2$), and aluminum oxide ($Al_2O_3$), none of which includes lead.

Production of Dielectric Paste

The dielectric material containing the constituent elements mentioned above is crushed by a wet jet mill or a ball mill to have a mean particle diameter of 0.5 μm to 3.0 μm, so that a powdery dielectric material is obtained. Next, the dielectric material powder by 50 wt. % to 65 wt. % and a binder component by 35 wt. % to 50 wt. % are mixed and kneaded by a triple roll mill so that a paste for dielectric layer to be subject to die coating or printing is obtained.

The binder component is terpineol or butyl carbitol acetate including ethyl cellulose or arylic resin by 1 wt. %-20 wt. %. The dielectric paste may further include, as a plasticizer, dioctyl phthalate, dibutyl phthalate, triphenyl phosphate, or tributyl phosphate. The dielectric paste may also further include, as a dispersant, glycerol monolaurate, sorbitan sesquioleate, HOMOGENOL (name of product supplied by Kao Corporation), or alkylaryl phosphate. The dielectric paste containing these materials has an improved printability.

Another Preferred Embodiment

In the description of the preferred embodiment given so far, front panel 2 was provided with white electrodes 4*b* and 5*b* respectively formed on black electrodes 4*a* and 5*a* provided on front glass substrate 3, and shielding layers 7. The present invention is not necessarily limited to the structure.

The present invention is applicable to front panel 2 where black electrodes 4*a* and 5*a* and shielding layer 7 are not formed. A coefficient of expansion of the black pigment included in black electrodes 4*a* and 5*a* and shielding layer 7 is smaller than a coefficient of expansion of silver (Ag) included in white electrodes 4*b* and 5*b*. Therefore, the present invention is applicable to front panel 2 where black electrodes 4*a* and 5*a* and shielding layer 7 are omitted.

INDUSTRIAL APPLICABILITY

As described thus far, the present invention is advantageous in obtaining an environment-friendly PDP capable of reliably acquiring a remarkable luminance level and a high reliability during a high-definition image display.

REFERENCE MARKS IN THE DRAWINGS

1 PDP
2 front panel
3 front glass substrate
4 scan electrode
4*a*, 5*a* black electrode
4*b*, 5*b* white electrode
5 sustain electrode
6 display electrode
7 black stripe (shielding layer)
8 dielectric layer
9 protective layer
10 back panel
11 back glass substrate
12 address electrode
13 ground dielectric layer
14 barrier rib
15 phosphor layer
16 discharge space

The invention claimed is:

1. A plasma display panel comprising:
a front panel; and
a back panel,
wherein the front panel and the back panel are disposed facing each other, and peripheries of the front panel and the back panel are sealed to form a discharge space,
the front panel has display electrodes, a dielectric layer, and a protective layer on a front substrate,
the back panel has electrodes, barrier ribs, and a phosphor layer on a back substrate,
wherein the display electrodes and the dielectric layer of the front panel are configured such that, in a graph in which an area percentage of the display electrodes in an area of an image display region of the front panel is expressed by a longitudinal axis, and a difference between a coefficient of expansion of the front substrate from room temperature to 300° C. and a coefficient of expansion of the dielectric layer from room temperature to 300° C. is expressed by a lateral axis, the area percentage and the difference between the coefficients of expansion stay within a region formed by connecting
coordinates ($35\times10^{-7}$/° C., 60%),
coordinates ($8\times10^{-7}$/° C., 60%),
coordinates ($5\times10^{-7}$/° C., 40%), and
coordinates ($23\times10^{-7}$/° C., 40%)
in the mentioned order with a straight line where the straight line is included,
wherein a content of $MoO_3$ in the dielectric layer is 0.3 mol % or more and 2 mol % or less.

2. The plasma display panel as claimed in claim 1, wherein the display electrodes and the dielectric layer of the front panel are configured such that the area percentage and the difference between the coefficients of expansion stay within a region formed by connecting
coordinates ($28\times10^{-7}$/° C., 60%),
coordinates ($15\times10^{-7}$/° C., 60%),
coordinates ($9\times10^{-7}$/° C., 40%), and
coordinates ($18\times10^{-7}$/° C., 40%)
in the mentioned order with a straight line where the straight line is included.

3. The plasma display panel as claimed in claim 2, wherein a total content of BaO and CaO in the dielectric layer is 17 mol % or less.

4. The plasma display panel as claimed in claim 3, wherein a total content of CuO and CoO in the dielectric layer is 0.1 mol % or more and 0.5 mol % or less.

5. The plasma display panel as claimed in claim 2, wherein a content of ZnO in the dielectric layer is 10 mol % or more and 50 mol % or less.

6. The plasma display panel as claimed in claim 5, wherein a total content of CuO and CoO in the dielectric layer is 0.1 mol % or more and 0.5 mol % or less.

7. The plasma display panel as claimed in claim 2, wherein a total content of CuO and CoO in the dielectric layer is 0.1 mol % or more and 0.5 mol % or less.

8. The plasma display panel as claimed in claim 1, wherein a total content of BaO and CaO in the dielectric layer is 17 mol % or less.

9. The plasma display panel as claimed in claim 3, wherein a total content of CuO and CoO in the dielectric layer is 0.1 mol % or more and 0.5 mol % or less.

10. The plasma display panel as claimed in claim 1, wherein a content of ZnO in the dielectric layer is 10 mol % or more and 50 mol % or less.

11. The plasma display panel as claimed in claim 10, wherein a total content of CuO and CoO in the dielectric layer is 0.1 mol % or more and 0.5 mol % or less.

12. The plasma display panel as claimed in claim 1, wherein a total content of CuO and CoO in the dielectric layer is 0.1 mol % or more and 0.5 mol % or less.

* * * * *